US005439132A

United States Patent [19]

Gorlich

[11] Patent Number: 5,439,132

[45] Date of Patent: * Aug. 8, 1995

[54] DUAL COVER PACKAGE

[75] Inventor: Michael P. Gorlich, Hilton Head Island, S.C.

[73] Assignee: World Class Packaging Systems, Inc., Hilton Head Island, S.C.

[ * ] Notice: The portion of the term of this patent subsequent to Sep. 20, 2011 has been disclaimed.

[21] Appl. No.: 221,194

[22] Filed: Mar. 31, 1994

Related U.S. Application Data

[63] Continuation-in-part of Ser. No. 64,700, May 20, 1993, Pat. No. 5,348,752.

[51] Int. Cl.[6] ..... B65D 41/00; B65D 51/18

[52] U.S. Cl. ..... 220/359; 220/256; 220/276; 229/123.1; 229/125.35

[58] Field of Search ..... 220/256, 257, 258, 276, 220/359; 229/123.1, 125.35

[56] References Cited

U.S. PATENT DOCUMENTS

| | | | |
|---|---|---|---|
| 2,880,859 | 4/1959 | Tupper | 220/359 |
| 3,344,974 | 10/1967 | Bostrom | 220/257 X |
| 3,391,847 | 7/1968 | Christine et al. | 220/359 X |
| 3,552,634 | 1/1971 | Ollier | 220/257 X |
| 3,561,668 | 2/1971 | Bergstrom | 220/359 X |
| 4,055,672 | 10/1977 | Hirsch et al. | 229/123.1 X |
| 4,555,043 | 11/1985 | Bernhardt | 220/306 |
| 4,555,056 | 11/1985 | Bernhardt | 229/45 R |
| 4,738,374 | 4/1988 | Ingemann | 220/258 |
| 4,939,332 | 7/1990 | Hahn | 220/359 X |
| 4,991,717 | 2/1991 | May et al. | 220/256 X |
| 5,348,752 | 9/1994 | Gorlich | 426/129 |

FOREIGN PATENT DOCUMENTS

| | | | |
|---|---|---|---|
| 9301104 | 1/1993 | WIPO | 220/359 |

*Primary Examiner*—Allan N. Shoap
*Assistant Examiner*—Vanessa Caretto
*Attorney, Agent, or Firm*—Arnold, White & Durkee

[57] ABSTRACT

A tray having a peripheral flange with one or more raised ledges to secure a pair of membranes to enclose the tray. A lower membrane may be attached to a first ledge of the flange. An upper membrane may be attached to a second ledge or a recessed lip of the flange without connection to the lower membrane, except through the tray. The two attachment surfaces may be separated by a trough or by being positioned on different levels to facilitate trimming of the upper membrane in a continuous manufacturing process. In one embodiment, each membrane may bear one or more selected labels. The upper membrane may, for example, bear a label intended for a retail operator, while the lower membrane bears a label designed for an ultimate purchaser of the packaged product. In another embodiment, the lower membrane has a higher permeability, and the upper membrane has a lower permeability. In this embodiment, a desired gaseous environment may be maintained within the package. When it is desired to change the gaseous environment, the upper (less permeable) membrane may be peeled away allowing gaseous communication through the lower (more permeable) membrane.

10 Claims, 3 Drawing Sheets

DUAL COVER PACKAGE

CROSS REFERENCE TO RELATED APPLICATION

This application is a continuation-in-part of appl. Ser. No. 08/064,700, now issued as U.S. Pat. No. 5,348,752, entitled "Dual State Food Packaging", in the name of the present inventor.

FIELD OF THE INVENTION

This invention relates to packages for objects such as food items. More specifically, the invention concerns a package with removable membranes useful in changing the condition of the packaged product or selectively displaying removable messages associated with the packaged product.

BACKGROUND OF THE INVENTION

Historically, meat products have been butchered and packaged in individual supermarkets or other retail outlets. It has long been recognized that this arrangement is extremely inefficient and expensive. Instead, it would be preferable to butcher and package the meat at a central efficient facility that benefits from economies of scale, and then to ship the meat to individual supermarkets or other retail outlets. Moreover, because of problems with waste disposal, butchering at a central location is preferable.

In the past, this desirable goal has not been achievable because most consumers prefer to buy meat which is red in color as a result of exposure to oxygen. However, the meat maintains its red color for only one to two days. Thereafter, it turns a purple color which is undesirable to most consumers.

Therefore, if the meat were butchered and packaged in one location and then shipped to another location for eventual sale, by the time the package reached the retail outlet the meat would have undergone the transformation to the purple color and would be effectively unsalable.

To overcome these problems, there have been a number of efforts to maintain the food product in a first atmosphere during shipping and a second atmosphere when the meat product is ready for retail sale. It is not believed that any of these techniques have yet achieved significant commercial acceptance. Therefore, it is highly desirable to provide a package that would permit remote meat preparation, and subsequent sale several days later.

One problem is that while the need for such a package is great, consumers may not be willing to invest much money in elaborate packages. Thus, it would be highly desirable to have a package that is convertible between two very different packaging conditions, and yet is very economical. Moreover, it is also advantageous for the package to look similar to packages to which consumers are currently accustomed.

One attempted solution to these problems is to use a dual layer cover over a plastic package containing the meat product. The upper cover is gas impermeable and may be removed to expose a lower cover that is air permeable. Thus, the package may be shipped with the upper cover intact so that a inert gaseous atmosphere may be maintained within the package during shipping. Then the upper cover may be removed at the supermarket leaving the lower cover. Since the lower cover is oxygen permeable, it allows the meat to bloom in the presence of oxygen.

Conventionally, such dual layer packages have been implemented by adhesively securing the upper layer to the lower layer and thereafter heat sealing or otherwise securing both layers to the package itself. For example, when the upper layer is removed the adhesive may be retained on the lower layer, interfering with the ability of the lower layer to pass oxygen. Also, when removing the top layer it may be difficult to avoid tearing or otherwise removing the lower layer. Moreover, it is difficult to produce such a package with controlled delamination of the two layers.

While various elaborate techniques have been conceived for avoiding the interference between the layers, these approaches generally add cost and complexity to the packaging. Moreover, the removal of the upper layer (which is sealed to the lower layer) without removing the lower layer is problematic. Although attempts have been made to overcome these problems, no commercially viable solution has been achieved.

SUMMARY OF THE INVENTION

These and other important advantages of the present invention may be achieved by a package with a tray and a pliant first membrane sealed to the tray. A pliant second membrane is sealed to the tray over the first membrane. The membranes are secured to the tray at separate locations on the tray. The membranes are substantially coplanar with one another and are removable from the tray independently of each other.

DETAILED DESCRIPTION OF THE PREFERRED EMBODIMENT

Figure 1:
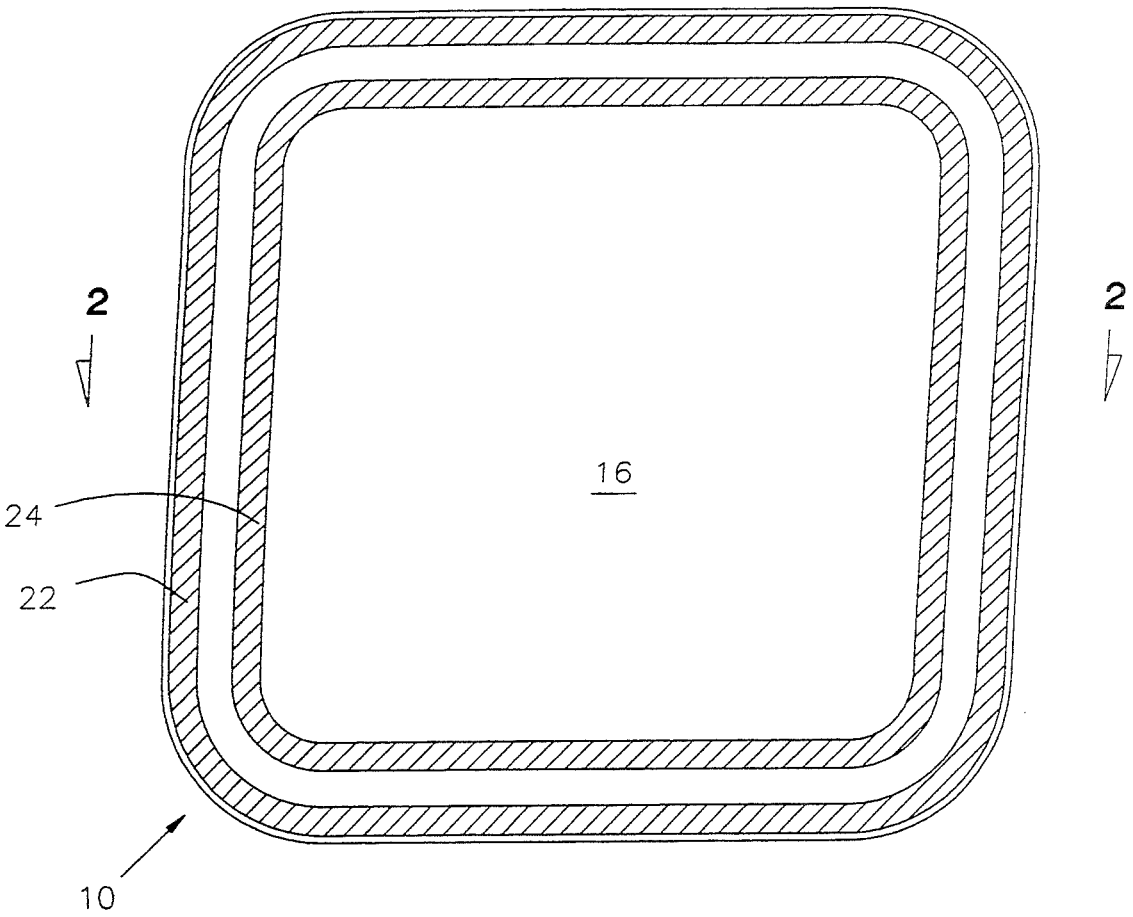
FIG. 1 is a plan view of one embodiment of a package 10 in accordance with the present invention.
Figure 2:
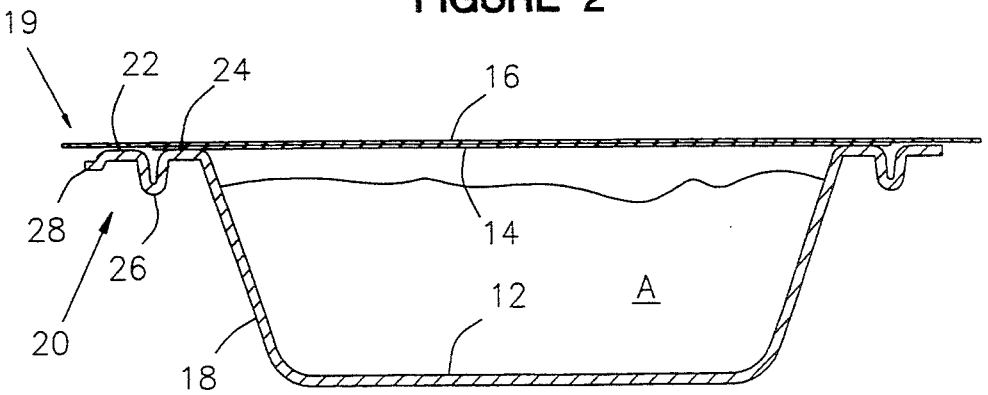
FIG. 2 is an enlarged side cross-sectional view of the package 10, taken along the line 2—2 of FIG. 1.

Referring to the drawings, wherein like reference characters are used for like parts throughout the several views, a package 10 for containing one or more food products "A" is shown (FIGS. 1–2). The package 10 is especially advantageous for containing red meat. The package 10 includes a relatively rigid tray 12, a more permeable membrane 14, and a less permeable membrane 16. The membranes 14 and 16 are peripherally connected to the tray 12.

The tray 12 may be made of a relatively rigid plastic, formed by thermomolding or the like. The tray is preferably made of a material which is gas impermeable, and may be composed of a single polymeric sheet such as polyvinyl chloride, nylon, fluorohalocarbon, polyurethane or a composite of polymeric materials including: PVC; PVC and polyolefin; PVC and saran; PVC and saran and polyolefin; PVC, saran, ethylenevinylacetate copolymer; polystyrene, saran and polyolefin; polystyrene, saran and copolymer; nylon, saran, polyolefin; polyolefin, saran and polyethylene; polyester, saran, polyolefin; polycarbonate, saran and polyolefin; or many other materials which are well known in the art. Advantageously, the tray 12 is preferably formed of a material that forms a good oxygen barrier, has adequate thermoformability, is sufficiently strong, and facilitates the attachment of other materials to the tray.

Although the tray 12 is shown in the illustrated embodiment as being generally rectangular, other shapes of the tray 12, such as a round form (not shown), are contemplated in accordance with the invention. The tray 12 includes a curved base 18 which defines a cavity for receiving the food product A, and a double flanged edge 20 which extends around the periphery of the base 18.

The double flanged edge 20 defines a pair of ledges 22 and 24 separated by a trough 26. The outermost edge 28 of the flange 20 may be turned downwardly. In an illustrative embodiment, the base 18 and the flange 20 may be molded as a single piece. In an exemplary embodiment, upper surfaces of the ledges 22 and 24 may be positioned in a single plane, such that the ledges 22 and 24 and the membranes 14 and 16 provide a substantially flat surface on top of the package 10. In this regard, the tray 12 may be formed from a porous, foam-like material that is heat pressed to ensure uniformity in the height of the ledges 22, 24 and the thickness of the tray 12. Such a flat surface facilitates a more reliable connection to the membranes 14, 16, and also permits multiple packages to be easily stacked on top of each other.

The more permeable layer 14 preferably comprises a flexible, resilient material such as a pliant plastic substance, to permit gaseous exchange therethrough as required by the particular application. In connection with the blooming of red meat, it is generally desirable that the more permeable membrane 14 be highly transmissive of ambient atmosphere. A wide variety of materials are capable of acting as the membrane 14, including polyvinyl chloride, polycarbonate, cellophane, polypropylene, polyethylene, polyethylene copolymers, ionomer film or any other gas permeable materials which are well known in the art. The membrane 14 may also be constructed of microporous films which have holes formed either chemically or mechanically. The membrane 14 need only be sufficiently strong to prevent perforation in use.

The membrane 14 is secured to the tray 12 at the inner ledge 24. In this regard, it is desirable that the membrane 14 be of a material that is heat sealable to the tray 12. However, it is also possible to adhesively secure the peripheral edge of the membrane 14 to the inner ledge 24. As used herein, the film is "sealed" to the tray, signifying that it is heat fused or adhesively secured to the tray as opposed to being frictionally connected thereto. Between the ledges 22 and 24, a trough 26 is defined. The trough 26 aids in securing the membrane 14 to the inner ledge 24. In particular, after the membrane 14 is stretched over the tray 12 and the ledges 22, 24, the membrane 14 is secured to the inner ledge 24, then trimmed by moving a cutting press downwardly through the membrane 14 and into the trough 26 as explained later. Although the trough 26 has a "U"-shape in FIG. 2, it is also understood that the trough 26 may assume a "V"-shape, a semi-circular shape, a rectangular shape, or another suitable shape that may be desired for aesthetic, functional, or other reasons.

The less permeable membrane 16 also preferably comprises a flexible, resilient material such as a pliant plastic substance. However, the membrane 16 is preferably selected from a group of materials that are relatively less gas permeable, such as polyester, nylon, cellophane, polypropylene, polyvinyl acetate, saran, or combinations of these materials. Advantageously, the less permeable membrane 16 is impermeable to gases.

The less permeable membrane 16 is removably secured to the outer ledge 22, again by heat sealing, adhesive techniques, or other techniques known in the art. After the less permeable membrane 16 is secured to the outer ledge 22, the membrane 16 may be trimmed by moving a cutting press downward through the membrane 16, at a position outward from the outermost edge 28 as explained later. Alternatively, if desired, the membrane 16 may be trimmed before sealing it to the outer ledge 22. In either case, the membrane 16 is preferably trimmed to leave an overhang 19, to facilitate later removal of the membrane 16 by lifting the overhang 19 and peeling the membrane 16 back from its connection to the outer ledge 22. The less permeable membrane 16, when secured to the ledge 22, is totally free of any connection to the more permeable membrane 14, except frictional connection or indirect connection through the tray 12. This facilitates the convenient removal of the less permeable membrane 16 from the package while leaving the more permeable membrane 14 in place and undisturbed. Although the membranes 14, 16 are not connected to each other, the membranes 14, 16 are substantially coplanar to each other, in face to face abutment, each advantageously being under slight resilient tension.

After both the membranes 14 and 16 are secured to the tray 12, a desirable atmosphere may be maintained within the package 10 for the benefit of the food product A contained therein. This may be done by sealing the package closed in the desired atmosphere. In the case of red meat products, the initial atmosphere in some embodiments may contain a relatively low concentration of oxygen. For example, gases including substantial concentrations of carbon dioxide or nitrogen may be maintained with the package to reduce the exposure of the food product A to oxygen. In the case of meat products, this forestalls the blooming of the meat product until a later time.

When the product reaches a supermarket or other retail outlet, it may be desirable to remove the less permeable membrane 16. This is conveniently done by grasping the edge of the upper membrane 16 and pulling it upwardly. Since the membrane 16 is not connected to the membrane 14, it may be easily removed from the remainder of the package 10.

Thereafter, the package 10 exists without the less permeable membrane 16, and includes only the more permeable membrane 14 and the tray 12. In embodiments containing meat products, it may be desirable to allow oxygen transmission through the more permeable membrane 14 to cause blooming of the meat product. Thus, in the store, once the less permeable membrane 16 has been removed, the red meat product A can be caused to turn red or bloom in the presence of a higher concentration of oxygen.

In an alternate embodiment, both membranes 14, 16 may be formed from substantially impermeable materials, for use in certain applications. This arrangement may be useful, for example, to provide alternative labeling schemes. With such an embodiment, the lower membrane may contain a label of a supermarket or other retail store, such as an advertising label; the upper membrane, on the other hand, may display a label from an initial meat packer, providing instructions to the retail butcher rather than the ultimate buyer of the meat. Then the outer membrane 16 may be easily removed relative to the inner membrane 14.

Figure 3:
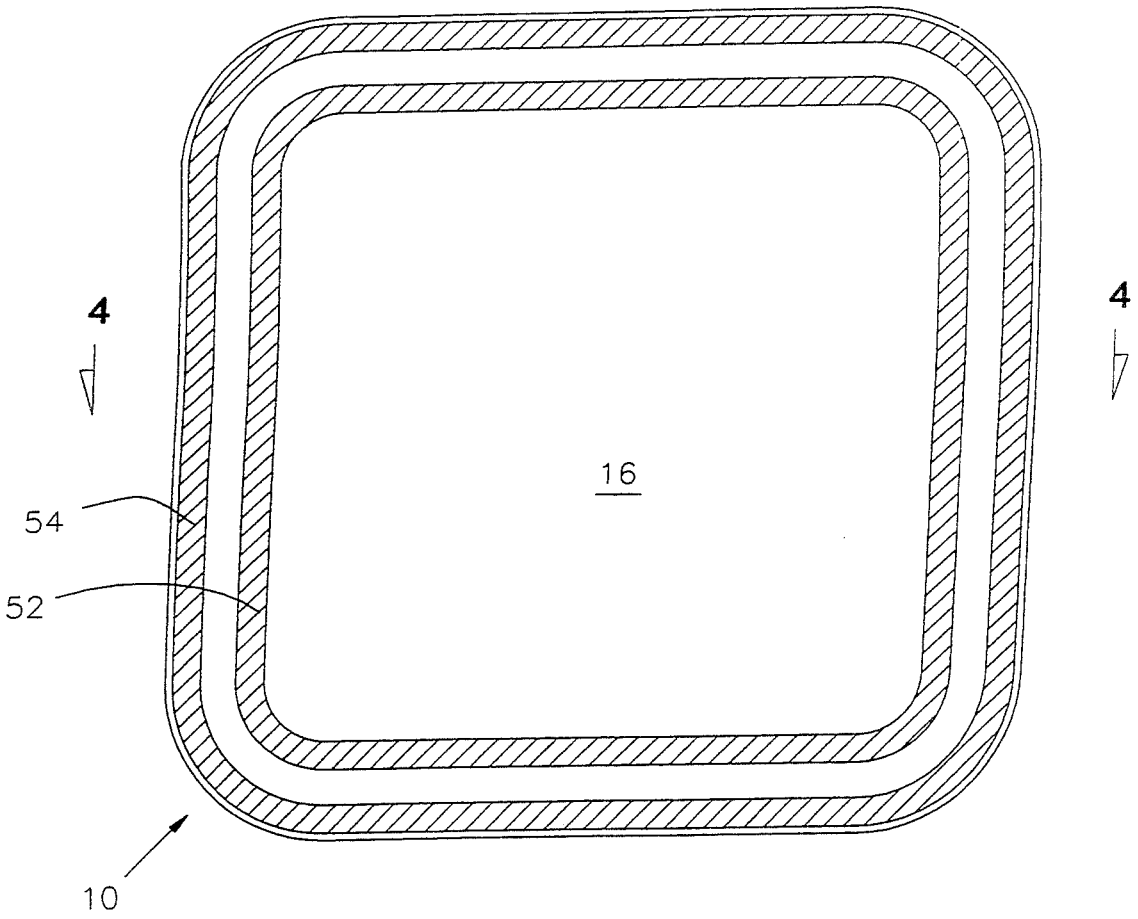
FIG. 3 is a plan view of another embodiment of the package 10 in accordance with the present invention.
Figure 4:
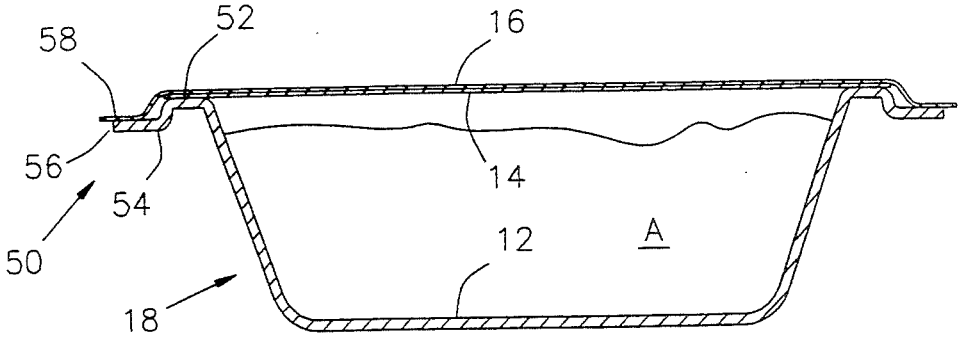
FIG. 4 is an enlarged side cross-sectional view of the package 10, taken along the line 4—4 of FIG. 3.

Referring to FIGS. 3–4, an alternate embodiment of the package 10 will be described. In particular, this embodiment contemplates a ledge 52, surrounded by a recessed lip 54 having an outermost edge 56. In this embodiment, the more permeable membrane 14 is first secured to the ledge 52, and then trimmed by moving a cutting press downwardly through the membrane 14 at a position radially outward from the ledge 52, as permitted by the recessed lip 54. Subsequently, the less permeable membrane 16 is stretched over the tray 12 and adhered to the lip 54. The less permeable membrane 16 is trimmed by moving a cutting press (not shown) downward through the membrane 16 at a position outward from the outermost edge 56. Thus, the less permeable membrane 16 is provided with a larger surface area than the more permeable membrane 14, such that the membrane 16 overlaps the membrane 14. The membrane 16 may be cut to provide an overhang 58, such that the less permeable membrane 16 may be easily removed by lifting the overhang 58 and peeling the membrane 16 back from its connection with the edge 56. Moreover, the membranes 14, 16 are substantially coplanar with each other, in face to face abutment, each being under slight resilient tension.

In this embodiment, the desired atmosphere may be maintained within the package 10, in the same manner as described above in conjunction with the previous embodiment. When the product reaches a supermarket or other retail market, the less permeable membrane 16 may be removed by conveniently grasping the overhang 58 of the membrane 16 in pulling it upward. Thereafter, the package 10 exists without the less permeable membrane 16 and includes only the more permeable membrane 14 and the tray 12, as with the embodiment described previously.

Figure 5:
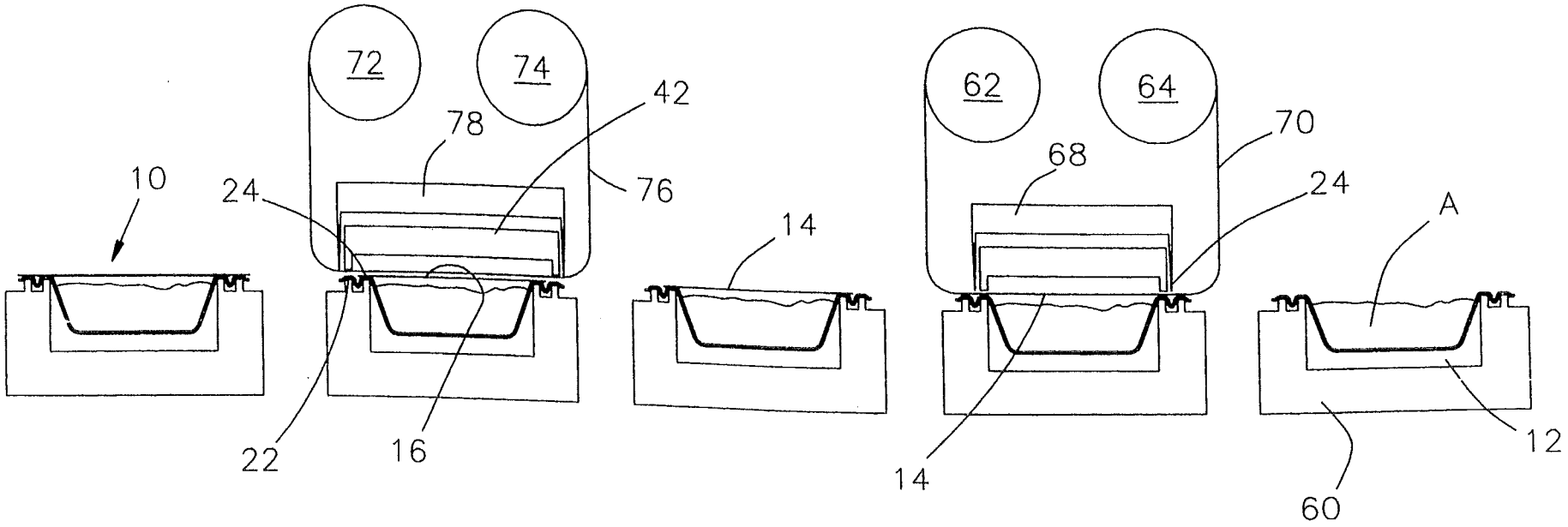
FIG. 5 is a schematic view showing a method for assembling the package 10 of FIG. 1.

Referring to FIG. 5, an exemplary process for forming the package 10 will be explained. Starting at the right side of FIG. 5, a tray 12, held from below in a rigid conforming carrier 60, is filled in a conventional fashion with a food product A. Next, the package 10 is evacuated of oxygen and gas back-filled with a transportation gas which is lower in oxygen content. A web 70 of the more permeable membrane 14 is unwound from a pair of rolls 62 and 64 and positioned over the tray 12. The more permeable web 70 is secured to the inner ledge 24, for example by a heat sealing machine 42. Thereafter, a conventional cutting press 68 is used to cut the web 70. In the embodiment of FIGS. 1–2, the web 70 is cut at a position adjacent to the trough 26. With the product of FIGS. 3–4, the web 70 is cut at a position over the recessed lip 54, the lip itself acting as a trough or depression. In either case, it should be clear that the trough 26 or lip 54 facilitates the removal or cutting of the membrane 14 from the web 70 in place on the package 10. The web 70 may also be severed by using heat or ultrasonic energy or the like.

At the next station, a web 76 of the less permeable material 16 is unrolled from a pair of rolls 72, 74 so that the less permeable web 76 may be positioned on the package 10. In the embodiment of FIGS. 1–2, the less permeable web 76 is secured to the ledge 22. In contrast, in the embodiment of FIGS. 3–4, the less permeable web 76 is secured to the outermost edge 56. In either case, this securing is performed using conventional techniques, such as using a heat sealing machine 42. At this point, the transportation gas is sealed inside the package 10. Finally, the web 76 is cut by conventional cutting equipment 78. In the embodiment of FIGS. 1–2, the cutting occurs slightly outward from the edge 28. In the embodiment of FIGS. 3–4, the cutting occurs slightly outward from the outer edge 56. This leaves an overhanging piece 19 or 58 of the less permeable material 16 which may be grasped by the user to remove the membrane 16 when desired.

When the package 10 has been assembled, the package may be shipped to locations for retail sale. At the retail establishment, the package is held until the package is ready to be displayed. At that point, the less permeable membrane 16 is peeled away and discarded. After a short holding period, the package may be displayed for retail sale. The holding period is necessary to allow the package to absorb oxygen through the more permeable membrane 14. After the meat product has bloomed, it can be displayed for retail sale.

It can be understood that through the provision of the trough 26 or lip 50, both membranes 14, 16 may be attached to the same tray 12 in a fashion that permits high speed manufacture. While the simplified process depicted in FIG. 5 suggests that the material may be packaged in a serial fashion, this approach would likewise apply to conventional packaging equipment.

Advantageously, the more permeable membrane is sufficient to maintain the desired gaseous environment in the package until the less permeable membrane is in place. This is especially true with high speed systems. However, in some circumstances it may be useful to provide a particular gaseous atmosphere between the stations where the more permeable and less permeable membranes are applied.

The same process can be used to make a package wherein both membranes are substantially impermeable.

Thus, it is apparent that there has been provided, in accordance with the invention, a method and apparatus that fully satisfies the aims and obvious advantages set forth above. While the invention has been described in connection with specific embodiments thereof, it is evident that many alternatives, modifications and variations will be apparent to those skilled in the art in light of the foregoing description. Accordingly, it is intended to embrace all such alternatives, modifications and variations as follow the spirit and scope of the appended claims.

What is claimed:

1. A package comprising:

a tray;

a flexible first membrane sealed to said tray; and a flexible second membrane sealed to said tray over said first membrane, said membranes being secured to separate locations on said tray such that said membranes are substantially coplanar with one another, said second membrane being removable from the tray independently of said first membrane; wherein said membranes substantially continuously contact one another.

2. The package of claim 1, wherein said tray includes a peripheral flange including a ledge and a lip surrounding the ledge to secure the first and second membranes, respectively.

3. The package of claim 1, wherein said tray includes a pair of substantially coplanar sealing ledges for securing said first and second membranes.

4. The package of claim 1, wherein the second membrane is less permeable than the first membrane to gases.

5. The package of claim 1, wherein the first and second membranes comprise a resilient material.

6. The package of claim 1, wherein said first and second membranes comprise a substantially impermeable material.

7. The package of claim 3, wherein the tray comprises a foam, said ledges being pressed to a substantially uniform thickness.

8. The package of claim 1, wherein the first and second membranes are only connected by way of said tray.

9. The package of claim 1, including a pair of sealing surfaces for receiving said first and second membranes, there being provided a recess between said surfaces designed to facilitate the severing of the first membrane from a web in place on the tray during manufacture of the package.

10. The package of claim 1, wherein said second membrane is peelable from said tray.

* * * * *

UNITED STATES PATENT AND TRADEMARK OFFICE

CERTIFICATE OF CORRECTION

PATENT NO. : 5,439,132
DATED : August 8, 1995
INVENTOR(S) : Michael P. Gorlich

It is certified that error appears in the above-indentified patent and that said Letters Patent is hereby corrected as shown below:

At column 6, lines 55-56, delete "substantially coplanar with one another" and insert in lieu thereof -- located in adjacent substantially parallel planes --.

At column 6, line 65, delete "substantially coplanar."

At column 6, line 66, after "membranes" insert -- , said ledges lying in adjacent substantially parallel planes --.

Signed and Sealed this

Ninth Day of January, 1996

*Attest:*

*Attesting Officer*

BRUCE LEHMAN

*Commissioner of Patents and Trademarks*